United States Patent [19]

Herbert

[11] Patent Number: 4,558,554

[45] Date of Patent: Dec. 17, 1985

[54] APPLICATION HEADS FOR APPLYING CLOSURES TO CONTAINERS

[75] Inventor: James F. Herbert, Cheslyn Hay, England

[73] Assignee: Metal Closures Limited, West Bromwich, England

[21] Appl. No.: 545,484

[22] Filed: Oct. 26, 1983

[30] Foreign Application Priority Data

Oct. 29, 1982 [GB] United Kingdom ..... 8231039

[51] Int. Cl.[4] ..... B65B 7/28; B67B 1/06

[52] U.S. Cl. ..... 53/331.5; 53/317

[58] Field of Search ..... 53/317, 331, 331.5, 53/334; 192/56 F

[56] References Cited

U.S. PATENT DOCUMENTS

| | | | |
|---|---|---|---|
| 3,491,516 | 1/1970 | Bergeron | 53/331.5 X |
| 3,913,301 | 10/1975 | Keller et al. | 53/331.5 |
| 4,246,738 | 1/1981 | Ono | 53/331.5 |
| 4,249,397 | 2/1981 | Guerra | 53/331.5 X |
| 4,295,320 | 10/1981 | Willingham | 53/331.5 X |

*Primary Examiner*—John Sipos
*Assistant Examiner*—Donald R. Studebaker
*Attorney, Agent, or Firm*—Roland T. Bryan

[57] ABSTRACT

A rotary application head for applying a screw-threaded closure to a container includes a collet 26 for gripping the closure, the collet being secured to a drive member 31 having an external flange 36 disposed between a thrust bearing 37 supported by the main body 10 and a friction clutch plate 38 backed by a pressure plate 40 which is driven by the body through pins 42. A piston 17 disposed in a pneumatic cylinder 16 in the body acts through push rods 19 to apply a predetermined axial loading between the pressure plate 40, friction clutch plate 30 and the flange 36. When the closure reaches a predetermined tightness, the reaction torque causes the collet and drive member to slip relative to the pressure plate and body, preventing over-tightening of the closure. External axial forces applied to the collet cause the piston 17 to be displaced axially to compensate for these forces without altering the torque at which slipping occurs.

6 Claims, 1 Drawing Figure

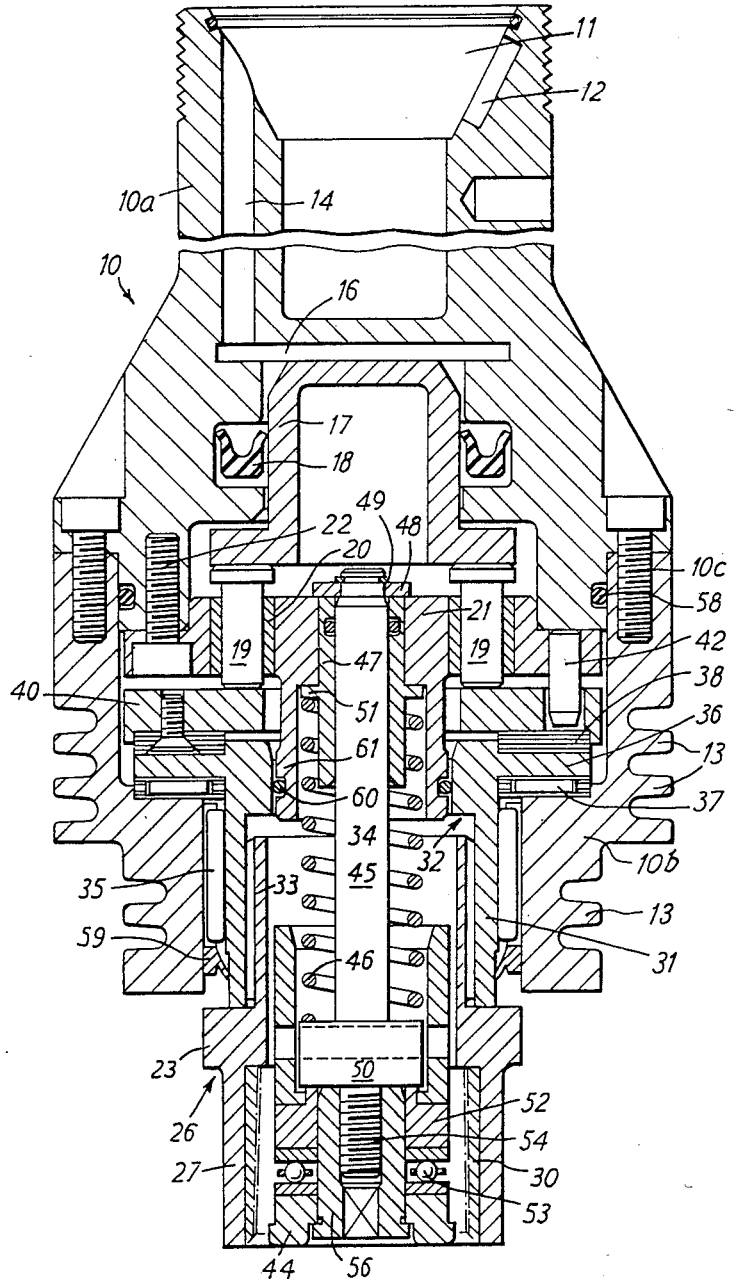
11
12
10a
14
10
16
17
18
49
22
48
20
10c
58
21
19
19
42
47
38
40
51
36
61
13
60
37
34
32
10b
35
33
45
13
59
31
46
23
50
52
26
54
27
30
53
44
56

APPLICATION HEADS FOR APPLYING CLOSURES TO CONTAINERS

This invention relates to application heads for applying closures to containers and is more particularly concerned with application heads for applying pre-formed screw-threaded closures to containers such as bottles.

According to this invention there is provided closure applying apparatus for applying a screw-threaded closure to a container, including an application head comprising a body part adapted to be driven in rotation about a lengthwise axis thereof, a rotary drive member which is journalled in the body part for rotation relative thereto about said axis and which is adapted to have connected to an end thereof an application collet for gripping the closure, said drive member having an annular external radially-extending flange which has oppositely-facing first and second surfaces facing respectively axially towards and away from said one end, a pressure plate which faces said second surface of the flange and which is connected to the body part to rotate with the body part but is capable of at least a degree of axial movement relative to the body part, friction pad means disposed between the pressure plate and said surface of the flange for transmitting a drive to the rotary drive member, rotary thrust bearing elements disposed between the drive member and the body part and arranged to support the drive member in opposition to the pressure plate, and said body part housing a piston and cylinder motor connected to press the pressure plate towards said surface of the flange with a predetermined axial force thereby to grip the friction pad means between the pressure plate and said flange, whereby rotational slip will occur between the body part and the rotary drive member with the torque applied to a collet carried by the drive member exceeds a predetermined value.

The application head may further comprise a cap member disposed coaxially within the rotary drive member and a collet carried thereby, which cap member is urged resiliently into engagement with the top of a closure engaged by the collet. Preferably the cap member is rotatably mounted on a stem portion axially slidably mounted in the body part, an axial thrust bearing being disposed between the cap and the stem.

According to another preferred feature of the invention, said axial force is applied by the motor to the pressure plate through a series of axial push rods spaced about said axis and mounted in the body part for axial sliding movement.

One embodiment of the invention will now be described by way of example, with reference to the accompanying drawing showing in axial section a form of application head according to the invention.

Referring to the drawing, there is shown an application head for applying a preformed threaded closure, for example a moulded plastics closure, to a container such as a bottle. The application head has a body part 10 comprising upper and lower sections 10*a*, 10*b* which are secured together in axial abutment by bolts 10*c*. The lower section 10*b* of the body part is annular and has external cooling fins 13. The body part has at its upper end a conical socket 11 with a slot 12 for a key to engage a complementary key-way on the lower end of a vertically disposed rotary drive shaft (not shown). The key ensures that a pressure fluid port on the said formation on the shaft is in register with a passage 14 in the body part. Passage 14 leads to the upper end of an axial cylinder 16 in the body part in which a piston 17 is mounted. The cylinder space below the piston is permanently vented to atmosphere by way of a passage which is not shown. The cylinder spaces at opposite axial sides of the piston are sealed from each other by a sealing ring 18 disposed in an annular recess in the cylinder wall. The piston has at its lower end a flange resting on the upper ends of four push rods 19 which are equiangularly disposed about the axis of rotation and which are slidably mounted in respective bushes 20 secured in a carrier member 21 which is secured across the lower end of the upper section 10*a* of the body member by bolts 22 and which forms the bottom end wall of the cylinder.

An annular collet 26 has one end portion 27 projecting from the lower end of the lower body section 10*b* and has an external flange 23. An internally serrated annular member 30 for gripping the sides of a closure is provided internally of the lower end portion of the collet. The portion of the collet above the flange is in screw-threaded engagement at 33 within a sleeve portion 31 of a drive member 32. A roller bearing 35 is disposed between the sleeve portion 31 and the body part. The drive member has at its upper end a radial flange 36, and a thrust bearing 37 is disposed between the lower face of the flange and an opposing surface of the body part. The upper face of the radial flange 36 is engaged by an annular friction clutch plate 38 which is secured by screws to the underside of a pressure plate 40, the upper side of which is abutted by the push rods 19. The pressure plate is free for axial movement by the piston 17 acting through the push rods 19, but is located against rotational and radial displacement relative to the body part by locating pins 42 secured in the carrier member 21 and extending axially into apertures in the pressure plate. The clutch plate 38 rests in a peripheral rebate on the flange and is disposed substantially in axial alignment with the thrust bearing 37.

A spring-loaded pad 44 is disposed centrally within the lower end portion of the collet 26 and is carried by an axially extending rod 45 which is loaded in a downward direction by a compression spring 46. The upper end part of the rod is slidably located in a bush 47 mounted centrally of the support member, downward movement of the rod being limited by a washer 48 and circlip 49 secured to the upper end of the rod. Near its lower end, the rod has an increased diameter portion 50 forming a shoulder, and the spring 46 is seated against an external flange 51 on the bush and acts against this shoulder. The pad 44 and a spacer 52 have disposed between them a thrust bearing 53 and this assembly is secured to a screw-threaded lower end portion 54 of the rod by an internally threaded bolt 56, the head of which is accommodated in a recess in the lower end of the pad. The pad is operated by the rod to press the closure down on the neck of the container under the pressure of the spring 46 but owing to the bearing 53 is freely rotatable relative to the rod. The chamber occupied by the clutch plate is sealed by sealing rings 58, 59, 60 respectively provided between the body sections 10*a* and 10*b* between the drive member and the body section 10*b*, and between the drive member and a sleeve 61 forming an axial extension of the carrier plate. The cooling fins 13 serve to dissipate the heat generated by slipping of the friction clutch.

In operation of the application head, a predetermined pneumatic pressure is applied against the upper side of the piston 17 which, through the push rods 19, presses the pressure plate 40 and clutch plates 38 into engagement with the flange of the drive member 32. The collet and serrated member 30 rotate with the drive member, the screw-threaded connection between the collet and drive member being of self-tightening hand. The head is lowered bodily with the drive shaft (not shown), and rotating therewith. This movement firstly brings the pad 44 into abutment with the top of the closure, and subsequently brings the internally serrated member 30 into gripping engagement with the sides of the closure. During the latter part of this movement, the pad moves upward relative to the collet, compressing the spring 46. On engagement with the stationary closure, the collet rotates the closure until the resistance torque of the closure to further tightening exceeds the torque exerted on the collet by the clutch plate, at which stage the clutch slips and rotation of the collet, pad 44 and the closure ceases, such rotation of these components relative to the body being permitted by bearings 35 and 37, and 53 respectively. The application head is then lifted bodily away from the bottle, and the pad 44, which is urged downward by the spring 46, pushes the closure out of engagement with the collet.

Thus since the maximum torque applied through the clutch is substantially constant the tightening torque applied to the closure is also substantially constant. In the event that a closure presented to the collet is tilted over or is off-centre and resting on top of the container neck, so that the collet is forced upward to a higher level than normal relative to the body, the constant pneumatic pressure applied to the piston 17 permits the drive member 32, friction plate 38, push rods 19 and the piston 17 to move upward together without any substantial increase of pressure between the flange 36 and friction plate so that the torque required to cause slipping to occur remains substantially unaltered.

If desired a thrust bearing may be incorporated between the collet/drive member assembly and the body to absorb upward forces applied to the collet. For example the bearing 35 may be a compound bearing incorporating a single row angle thrust bearing, or a thrust bearing may be incorporated between a flange on the collet and the body.

It will be undertood that the pressure applied to the piston determines the torque value at which the clutch will slip, and the pressure is therefore adjusted according to the closures to be applied.

Identical application heads can conveniently be mounted on a series of rotary shafts carried in respective mountings which are moved round a central axis in a manner described in more detail in our U.K. Patent Specification No. 1369793. Each shaft mounting is suspended from a cam follower roller engaged in an endless stationary cam track extending about the central axis, and the cam track controls the downward and upward movement of the rotary shafts for moving the application heads into and out of engagement with the closures being applied. In such a machine the pneumatic pressure applied in the cylinders of the application heads is controlled from a central location so that the slipping value of the torque can be adjusted for all the clutches simultaneously.

I claim:

1. Closure applying apparatus for applying a screw-threaded closure to a container, including an application head comprising a body part adapted to be driven in rotation about a lengthwise axis thereof and having an inwardly directed shoulder with an axially facing supporting surface, a rotary drive member which is journalled in the body part for rotation relative thereto about said axis and which is adapted to have connected to an end thereof an appication collet for gripping the closure, said drive member having an annular external radially-extending flange which has oppositely-facing first and second surfaces respectively facing axially towards and away from one end with said first surface facing towards said supporting surface, a pressure plate which faces said second surface of the flange and which is connected to the body part to rotate with the body part but is capable of at least a degree of axial movement relative to the body part, friction pad means disposed between the pressure plate and said surface of the flange for transmitting a drive to the rotary drive member, rotary thrust bearing elements disposed between the first surface of the drive member and said supporting surface of the body part and arranged to support the drive member in opposition to the pressure plate, and said body part housing a piston and cylinder motor connected to press the pressure plate towards said second surface of the flange with a predetermined axial force thereby to grip the friction pad means between the pressure plate and said flange, whereby rotational slip will occur between the body part and the rotary drive member when the torque applied to a collet carried by the drive member exceeds a predetermined value.

2. Closure applying apparatus as claimed in claim 1 wherein said rotary thrust bearing elements comprise thrust bearing rollers disposed between said abutment surface and said first surface.

3. Closure applying apparatus as claimed in claim 2, further comprising a roller bearing providing a journal for the drive member within the body.

4. Closure applying apparatus as claimed in claim 1, comprising a series of axial push rods disposed between the motor and the pressure plate, which rods are spaced about said axis and mounted in the body part for axial sliding movement.

5. Closure applying apparatus as claimed in claim 1, further comprising a cap member disposed co-axially within the rotary drive member and a collet carried thereby, which cap member is urged resiliently into engagement with the top of a closure engaged by the collet.

6. Closure applying apparatus as claimed in claim 5, comprising a stem portion which is axially slidably mounted in the body part and on which the cap member is carried, an axial thrust bearing disposed between the cap and the stem for enabling the cap member to rotate relative to the stem.

* * * * *